US012357102B2

(12) United States Patent
Chang et al.

(10) Patent No.: US 12,357,102 B2
(45) Date of Patent: Jul. 15, 2025

(54) AIR MATTRESS AND METHOD OF CONTROLLING THE SAME

(71) Applicant: APEX MEDICAL CORP., New Taipei (TW)

(72) Inventors: Chih Kuang Chang, New Taipei (TW); Yen Chieh Chen, New Taipei (TW); Sheng Wei Lin, New Taipei (TW); Po Han Wei, New Taipei (TW)

(73) Assignee: APEX MEDICAL CORP., New Taipei (TW)

( * ) Notice: Subject to any disclaimer, the term of this patent is extended or adjusted under 35 U.S.C. 154(b) by 541 days.

(21) Appl. No.: 17/549,462

(22) Filed: Dec. 13, 2021

(65) Prior Publication Data

US 2022/0265060 A1 Aug. 25, 2022

Related U.S. Application Data

(60) Provisional application No. 63/153,574, filed on Feb. 25, 2021.

(30) Foreign Application Priority Data

Aug. 6, 2021 (TW) ..... 110129197

(51) Int. Cl.
*A47C 27/10* (2006.01)
*A47C 20/04* (2006.01)
*A47C 27/08* (2006.01)

(52) U.S. Cl.
CPC ..... *A47C 27/10* (2013.01); *A47C 20/048* (2013.01); *A47C 27/081* (2013.01)

(58) Field of Classification Search
CPC .... A61G 13/1265; A61G 13/121; A61G 7/07; A61G 9/1027; A61G 27/081;
(Continued)

(56) References Cited

U.S. PATENT DOCUMENTS 6,058,538 A * 5/2000 Chapman ..... A61G 7/05776 5/713
7,849,544 B2 * 12/2010 Flocard ..... A61G 7/05769 5/713

(Continued)

FOREIGN PATENT DOCUMENTS

WO WO-9917703 A1 * 4/1999 ..... A61G 7/05776

OTHER PUBLICATIONS

NPL search (Year: 2025).*

*Primary Examiner* — Justin C Mikowski
*Assistant Examiner* — Amanda L Bailey
(74) *Attorney, Agent, or Firm* — RABIN & BERDO, P.C.

(57) ABSTRACT

An air mattress includes a first air cell, a second air cell, a plurality of third air cells, and a body-lifting air cell. The second air cell includes a first air chamber, a second air chamber, and a structurally-weakened region. The body-lifting air cell is below the second air cell and at least one of the third air cells. The body-lifting air cell is inflated by an air source controlled by a control system. When the body-lifting air cell is inflated, a vertical distance between the top of second air cell and the bottom of air mattress is greater than a vertical distance between the top of first air cell and the bottom of air mattress. When the body-lifting air cell is inflated, the second air cell has a lower structural strength than the other air cells to have a cushioning effect against external forces.

12 Claims, 11 Drawing Sheets

(58) Field of Classification Search
CPC .. A61G 7/05769; A47C 20/026; A47C 20/04; A47C 27/10; A47C 27/087; A47C 27/18; A47C 27/08; A47C 27/081; A47C 27/082; A47C 27/083; A47C 20/02; A47C 20/00
See application file for complete search history.

(56) References Cited

U.S. PATENT DOCUMENTS

| | | | | |
|---|---|---|---|---|
| 7,992,241 | B2 * | 8/2011 | Davis, III | A47C 20/048 5/710 |
| 8,104,126 | B2 * | 1/2012 | Caminade | A61G 7/05776 5/713 |
| 10,112,513 | B2 * | 10/2018 | Patrick | B60N 2/5621 |
| 2004/0255386 | A1 * | 12/2004 | Liu | A61G 7/05776 5/710 |
| 2011/0203053 | A1 * | 8/2011 | Mulliez | A61G 7/05769 5/712 |
| 2013/0340168 | A1 * | 12/2013 | Meyer | A61G 7/002 5/615 |
| 2020/0078241 | A1 * | 3/2020 | Chang | A47C 27/082 |

* cited by examiner

AIR MATTRESS AND METHOD OF CONTROLLING THE SAME

CROSS-REFERENCES TO RELATED APPLICATIONS

This application claims the benefit of U.S. provisional application Ser. No. 63/153,574, filed on Feb. 25, 2021 and claims the priority of Patent Application No. 110129197 filed in Taiwan, R.O.C. on Aug. 6, 2021. The entirety of the above-mentioned patent applications are hereby incorporated by references herein and made a part of the specification.

BACKGROUND

Field of the Invention

The present disclosure relates to patient body support technology and, more particularly, to an air mattress and a method of controlling the same.

Description of the Prior Art

Bedridden, physically disabled patients are predisposed to development of bedsores for lack of position changing or physical activities. The bedsores cause discomfort or even cause a health risk issue to the patients.

In some circumstances, the patients (especially those with respiratory diseases) have to lie in a prone position to increase the patients' blood oxygen level. Medical tubes are inserted into the nose and mouth of the patients lying in a prone position to help with breathing. To avoid obstructing the medical tubes, patient lying in a prone position should have one side of his/her face contacting the top side of the air mattress. And to reduce the chance of developing facial bedsores which is caused by pressing the same side of the face for a long period of time, turning the patient's face over appropriately within a predetermined period is needed, such that the facial bedsores could be prevented.

Conventionally, two or more healthcare workers are included to turn a prone patient's head without causing discomfort to the patient. For instance, two healthcare workers together lift the patient's shoulders and the third healthcare worker holds and turns the patient's head while ensuring that all the medical tubes are in place and are not obstructed. However, the aforesaid conventional procedure takes up too much healthcare labor resources.

SUMMARY OF THE INVENTION

In view of these, the present disclosure provides an air mattress and a method of controlling the same. In some embodiments, the present disclosure is effective in lifting the patient's shoulder-thorax region automatically to provide a face-face-turnover space for the patient and thereby easily turn the patient's head/face with fewer healthcare workers.

According to some embodiments, an air mattress adapted to be selectively inflated or deflated by an air source, such as air pump controlled by a control system. The air mattress comprises at least one first air cell at a head end of the mattress, a second air cell, a plurality of third air cells and a body-lifting air cell. The second air cell is adjacent to the at least one first air cell. The second air cell comprises a first air chamber, a second air chamber adjacent to the first air chamber, and a structurally-weakened region is enclosed in the second air cell. The third air cells are adjacent to the second air cell. The body-lifting air cell is positioned below the second air cell and at least one of the third air cells. When the air mattress is in use, the air source inflates the body-lifting air cell to lift the second air cell and at least one of the third air cells, such that a vertical distance between the top of the second air cell and the bottom of the air mattress is a first distance, and a vertical distance between the top of the at least one first air cell and the bottom of the air mattress is a second distance, wherein the first distance is greater than the second distance. When the air mattress is in use, the structurally-weakened region has a lower structural strength than any other air cell, and thus the second air cell has a cushioning effect against external forces.

According to some embodiments, a method of controlling an air mattress is provided. The air mattress comprises at least one first air cell, a second air cell, a plurality of third air cells, and a body-lifting air cell. The air mattress is controlled by a control system when the air mattress is in use. The method comprises controlling an air source to inflate the at least one first air cell, the second air cell and the third air cells; and controlling the air source to inflate the body-lifting air cell and thereby provide a face-face-turnover space. The second air cell supports the shoulder-neck region of the patient, and thus the patient's face can be turned over within the face-face-turnover space. The structurally-weakened region enclosed in the second air cell enables the second air cell to have a cushioning effect against external forces.

In conclusion, according to some embodiments, the present disclosure is effective in inflating the body-lifting air cell to lift the patient's shoulder-thorax region automatically and to provide a face-turnover space to turn the patient's head/face with fewer healthcare labor resource. In some embodiments, with the patient's shoulder-thorax region being lifted, the structurally-weakened region in the second air cell enables the second air cell to have a cushioning effect against external forces. For example, the pressure exerted by the patient's shoulder-neck region on the second air cell is reduced through the structurally-weakened region while the second air cell supporting the patient's shoulder-neck region. In addition, the risk of hyperextension caused by over extending the prone patient's vertebral column, especially cervical spine, excessively is reduced. In some embodiments, the pressure exerted on the lateral face (especially the ear) of the prone patient is reduced through an orifice of a buffer layer, and thus the chance of developing bedsores on the prone patient's face is also reduced.

DETAILED DESCRIPTION OF THE EMBODIMENTS

Terms such as "first" and "second" used herein are used to distinguish between referred components, rather than being used to sort the referred components or limit differences in the referred components or limit the scope of the present invention.

Figure 1:
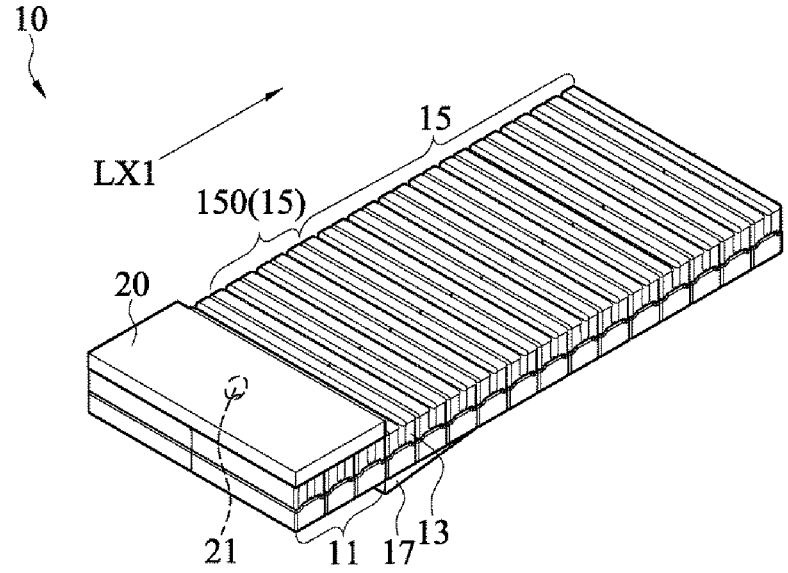
FIG. 1 is a perspective view of an air mattress according to some embodiments of the present disclosure.

Referring to FIG. 1, FIG. 1 is a perspective view of an air mattress 10 according to some embodiments of the present disclosure. The air mattress 10 comprises at least one first air cell 11 (herein after at least one head air cell 11), a second air cell 13 (herein after a shoulder-neck air cell 13), a plurality of third air cells 15 (herein after a plurality of torso air cells 15), and a body-lifting air cell 17. The air mattress 10 is adapted to support the body of a patient in a supine or prone position. The patient is face up (that is, the back side of the head of the patient toward to the top side of the air mattress 10) when lying supine on the top side of the air mattress 10, and faces downward (that is, the face of the head of the patient toward to the top side of the air mattress 10) when lying prone on the top side of the air mattress 10.

The head air cell 11 is adapted to be inflated in order to support the head region of the patient. The head region includes any regions above the shoulders of the patient, a head-neck region of the patient, the head and its surrounding regions of the patient, or the head of the patient. Although FIG. 1 shows only three head air cells, the present disclosure is not limited thereto. In a variant embodiment, the head air cells 11 are in the number of one, two, four or more, or are integrally formed. In some embodiments, the head air cells 11 are adjacently arranged in an array. In some embodiments, the head air cells 11 are at one end of a major axis direction LX1 of the air mattress 10 and arranged along the major axis direction LX1. When the patient is supine or prone, the head air cells 11 correspond in position to the head region of the patient.

The shoulder-neck air cell 13 is adapted to be inflated in order to support the shoulder-neck region of the patient. The shoulder-neck region is the shoulders and the neck of the patient, the shoulders of the patient, or the neck and its surrounding regions of the patient. The shoulder-neck air cell 13 is adjacent to the head air cells 11. In some embodiments, the shoulder-neck air cell 13 follows the head air cells 11 along the major axis direction LX1 of the air mattress 10. When the patient is supine or prone, the shoulder-neck air cell 13 corresponds in position to the shoulder-neck region of the patient. The shoulder-neck air cell is in a plural number according to the length and the width of the shoulder-neck region of the patient.

The torso air cells 15 are adapted to be inflated in order to support the torso region of the patient. The torso region includes regions below the patient's shoulders. Although FIG. 1 shows nine torso air cells, the present disclosure is not limited thereto. In a variant embodiment, the torso air cells 15 are in any number other than nine. The torso air cells 15 are adjacent to the shoulder-neck air cell 13. The shoulder-neck air cell 13 is between the head air cells 11 and the torso air cells 15 (that is, the shoulder-neck air cell 13 separates the head air cells 11 from the torso air cells 15). In some embodiments, the torso air cells 15 follow the shoulder-neck air cell 13 along the major axis direction LX1 of the air mattress 10. When the patient is supine or prone, the torso air cells 15 correspond in position to the torso region of the patient.

The body-lifting air cell 17 is below the shoulder-neck air cell 13 and at least one of the torso air cells 15 (the at least one of the torso air cells 15 are hereafter referred to as thorax air cells 150). The body-lifting air cell 17 is adapted to be inflated in order to lift the shoulder-neck air cell 13 and the thorax air cells 150 (in the direction of the top side of the air mattress 10), thereby lifting the shoulder-neck region of the patient or lifting the shoulder-neck region and the thorax region of the patient. The shoulder-neck region and thorax region are collectively known as the shoulder-thorax region.

In some embodiments, the head air cells 11, the shoulder-neck air cell 13, the torso air cells 15, and the body-lifting air cell 17 each have a through hole. The through hole of the shoulder-neck air cell 13, the torso air cells 15, and the body-lifting air cell 17 is to inflate or deflate the shoulder-neck air cell 13, the torso air cells 15, and the body-lifting air cell 17. In some embodiments, the aforesaid air cells undergo inflation and deflation through the through hole independently or jointly, and both the inflation and deflation through the through hole are controlled by an air mattress control system and/or by a manual control.

Figure 2:
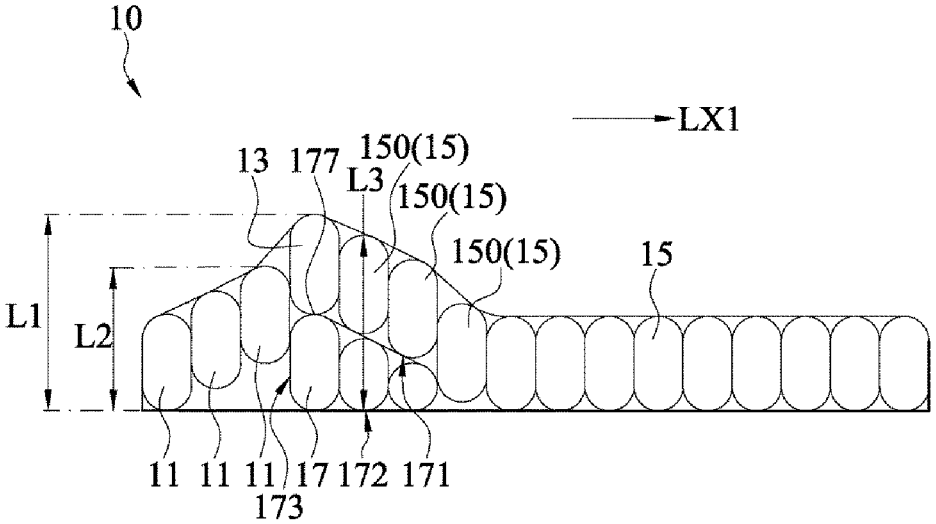
FIG. 2 is a left schematic view of the air mattress when a body-lifting air cell is inflated according to some embodiments of the present disclosure.

Referring to FIG. 2, FIG. 2 is a left schematic view of the air mattress 10 when the body-lifting air cell 17 is inflated according to some embodiments of the present disclosure. When the body-lifting air cell 17 is inflated, a vertical distance between the top of the shoulder-neck air cell 13 and the bottom of the air mattress 10 is known as a first distance L1, a vertical distance between the top of any one of the head air cells 11 and the bottom of the air mattress 10 is known as a second distance L2, and a vertical distance between the top of the at least one of the torso air cells 15 (i.e., thorax air cells 150) above the body-lifting air cell 17 and the bottom of the air mattress 10 is known as a third distance L3. The first distance L1 is greater than the second distance L2 and the third distance L3. In other words, when the body-lifting air cell 17 is inflated, the height of the shoulder-neck air cell 13 is greater than the height of any one of the head air cell 11 and the thorax air cells 150. Therefore, the height of the shoulder-neck region of the patient lying on the air mattress 10 is greater than the height of the head region and the torso region of the patient lying on the air mattress 10. The thorax of the patient is substantially supported by the thorax air cells 150 to a great extent to thereby reduce the thoracic pressure of the patient and improve the comfort of the patient. Furthermore, a face-turnover space is produced at the head-front segment of the patient (for example, the region on the air mattress 10 which corresponds in position to the head air cell 11) to allow healthcare workers to turn over the head/face of the patient easily.

In some embodiments, when the body-lifting air cell 17 is inflated, the at least one of the torso air cells 15 (i.e., thorax air cells 150) above the body-lifting air cell 17 form an acute angle with the bottom of the air mattress 10, and the acute angle ranges from 5° to 40°. In a preferred embodiment, the acute angle ranges from 10° to 35°. In another preferred embodiment, the acute angle ranges from 15° to 30°. In yet another preferred embodiment, the acute angle ranges from 20° to 25°. For instance, the acute angle is adjusted by the control system according to the angle of the joint of the neck and the shoulders, or the acute angle is adjusted by the control system according to the body weight of the patient lying on the air mattress 10. In general, the range of the acute angle is adjusted in such a way that the cervical spine and the spinal joints of the patient are not at risk of hyperextension due to an excessive extension.

There are connective structures (for example, connective pipelines for use in air delivery) between the head air cells 11 and the shoulder-neck air cell 13, between the head air cells 11 and the torso air cells 15, or between the head air cells 11 and the body-lifting air cell 17. Therefore, when the shoulder-neck air cell 13 and the thorax air cells 150 are lifted, the head air cells 11 are also lifted passively. Since the head air cells 11 are lifted passively, the lifted distance of the head air cells 11 is shorter than the lifted distance of the shoulder-neck air cell 13 and the lifted distance of the thorax air cells 150. For instance, the first distance L1 (that is, the lifted distance of the shoulder-neck air cell 13) is greater than third distance L3 (that is, the lifted distance of the thorax air cells 150), and third distance L3 is greater than second distance L2 (that is, the lifted distance of the head air cells 11). In some embodiments, the second distance L2 of each of the head air cells is different when the body-lifting air cell 17 is inflated (that is, the second distance L2 varies from one head air cell 11 to another head air cell 11 when the body-lifting air cell 17 is inflated). For instance, the second distance L2 of the head air cells 11 progressively increases along major axis direction LX1 of the air mattress 10. Specifically, the second distance L2 of the head air cell 11 adjacent to the shoulder-neck air cell 13 is greater than second distance L2 of the head air cell 11 distal to the shoulder-neck air cell 13. Therefore, at one end of major axis direction LX1 of the air mattress 10, the top side of the head air cell 11 of the air mattress 10 forms a slope and produces a face-turnover space, such that healthcare workers can turn over the head of the patient easily. In other words, the shoulder-neck air cell 13 and the thorax air cells 150 are lifted by the body-lifting air cell 17 to support and keep the upper half of the torso of the patient at a specific height, such that healthcare workers can lift the torso of the patient efficiently.

Likewise, in some embodiments, the third distance L3 of each of the thorax air cell 150 is different when the body-lifting air cell 17 is inflated (that is, the third distance L3 varies from one thorax air cell 150 to another thorax air cell 150 when the body-lifting air cell 17 is inflated). For instance, the third distance L3 of the thorax air cells 150 progressively decreases along the major axis direction LX1 of the air mattress 10. Specifically, the third distance L3 of the thorax air cells 150 adjacent to the shoulder-neck air cell 13 is greater than the third distance L3 of the thorax air cells 150 distal to the shoulder-neck air cell 13. The progressively decreasing height not only allows the thorax of the patient to be supported but also allows the abdomen of the patient to be supported while bearing less pressure than the thorax, and thus the patient can lie on the air mattress pronely and comfortably, especially in the course of medical therapy.

Figure 3:
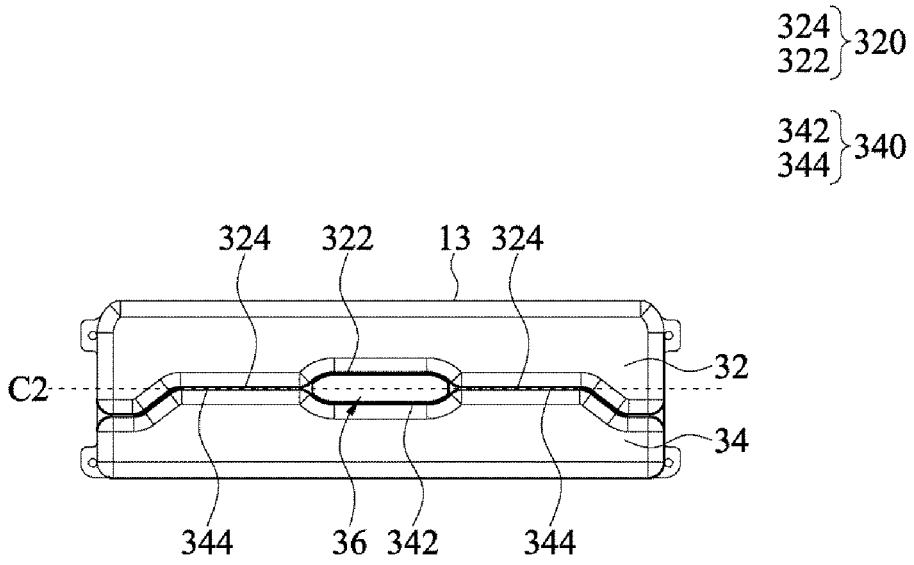
FIG. 3 through FIG. 12 are front schematic views of a shoulder-neck air cell according to some embodiments of the present disclosure.

Referring to FIG. 3, FIG. 3 is a front schematic view of the shoulder-neck air cell 13 according to some embodiments of the present disclosure. The shoulder-neck air cell 13 comprises a first air chamber 32 and a second air chamber 34 adjacent to the first air chamber 32. The shoulder-neck air cell 13 further comprises a structurally-weakened region 36 enclosed in the shoulder-neck air cell 13. In some embodiments, the first air chamber 32 and the second air chamber 34 each comprise a connecting segment, for example, a connecting segment 320 of the first air chamber 32 and a connecting segment 340 of the second air chamber 34. The two connecting segments 320, 340 form an enclosure to be the structurally-weakened region 36. The two connecting segments 320, 340 are adjacent to each other. The shoulder-neck air cell 13 is divided into the first air chamber 32 and second air chamber 34 through the two connecting segments 320, 340. In some embodiments, the first air chamber 32 is above the second air chamber 34. Therefore, the first air chamber 32 is closer to the top side of the air mattress 10 than the second air chamber 34.

Figure 4:
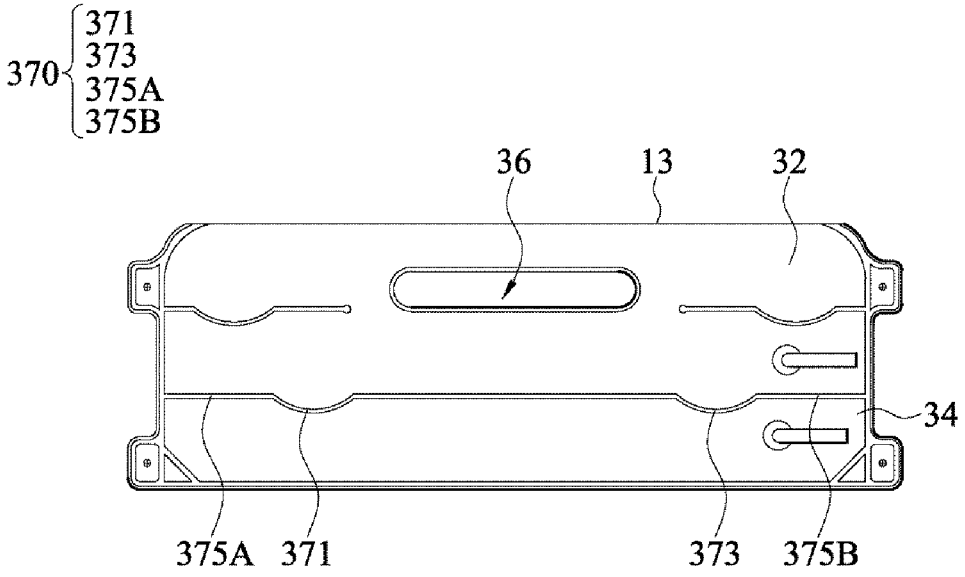

Referring to FIG. 4, FIG. 4 is a front schematic view of the shoulder-neck air cell 13 according to some embodiments of the present disclosure. In some embodiments, the structurally-weakened region 36 disposed in the first air chamber 32 or second air chamber 34 is self-contained. For instance, as shown in FIG. 4, a connecting segment 370 is disposed between the first air chamber 32 and the second air chamber 34. The connecting segment 370 comprises at least one retracting segment (for example, a third retracting segment 371 and a fourth retracting segment 373) and at least one adjoining segment connected to the at least one retracting segment (for example, an adjoining segment 375A connected to the third retracting segment 371 and an adjoining segment 375B connected to the fourth retracting segment 373). The structurally-weakened region 36 is disposed in the first air chamber 32 or second air chamber 34, and the structurally-weakened region 36 is substantially not connected to the connecting segment 370 (that is, the structurally-weakened region 36 disposed in the first air chamber 32 or second air chamber 34 is self-contained). Although FIG. 4 shows that the connecting segment 370 comprises two retracting segments and two adjoining segments, but the present disclosure is not limited thereto. In a variant embodiment, the retracting segments of the connecting segment 370 are in the number of one or in a number greater than two, wherein the adjoining segments of the connecting segment 370 are in the number of one or in a number greater than two. The retracting segments of the connecting segment 370 increase the resistance between the first air chamber 32 and the second air chamber 34. Therefore, when the patient is lying on the air mattress 10, the first air chamber 32 will not collapse due to the weight of the patient. In other words, the first air chamber 32 and the second air chamber 34 are of the same height, thereby providing the support required to reduce the folding of a single tube (air cell) or the collapse of the single tube. In some embodiments, the retracting segments (also may be known as curved regions according to its shape shown in FIG. 4) form an upward bulge for a deviation distance or a downward denting for a deviation distance. In a preferred embodiment, one air cell has a plurality of retracting segments distributed within a plurality of connecting segments. The plurality of connecting segments may be a upper connecting segment and a lower connecting segment. The plurality of retracting segments may divide a single-tube (i.e., single air cell) into a first chamber, a second chamber, and a third chamber. The plurality of retracting segments respectively distributed within the upper connecting segment and the lower connecting segment are alternately arranged in a direction perpendicular to the top side of the air mattress 10. As shown in FIG. 4, the plurality of retracting segments (curved regions) arranged in asymmetric. The curved regions of the asymmetric retracting segments may provide an additional support force for the curved surfaces of the curved regions when the air cells are in an inflated state, and the prevention of the folding of the tube (air cell) may further be achieve.

In some embodiments, the adjoining segment of the connecting segment 370 not only connects to single retracting segment but also connects to multiple retracting segments. For instance, the adjoining segment of the connecting segment 370 connects the third retracting segment 371 and the fourth retracting segment 373. One end of the adjoining segment connects to the third retracting segment 371. The other end of the adjoining segment connects to the fourth retracting segment 373.

In some embodiments, when the air mattress 10 is in use (for example, when the air cells of the air mattress 10 are in an inflated state, and the patient is lying on the air mattress 10), the structurally-weakened region 36 provides a cushioning effect against external forces for the shoulder-neck air cell 13. For instance, when the body-lifting air cell 17 lifts the shoulder-thorax region of the patient, the structurally-weakened region 36 reduces the pressure exerted by the shoulder-neck region of the patient on the shoulder-neck air cell 13 while the shoulder-neck air cell 13 is supporting the shoulder-neck region of patient.

In some embodiments, the structurally-weakened region 36 is a hollowed-out region. In a preferred embodiment, the hollowed-out region has a hollow core. Therefore, for the shoulder-neck air cell 13 with a hollowed-out region, the local space within the shoulder-neck air cell 13 may not have a fluidic communication or the local space within the shoulder-neck air cell 133 may have a fluidic blocking area, so that the local space is substantially unsupported. Thus, a support effect is weaker at the local space of the shoulder-neck air cell 13 than the other air cells, and the shoulder-neck air cell 13 has a cushioning effect. In addition, the structurally-weakened region 36 of the shoulder-neck air cell 13 does not cause insufficient support for the shoulder and the neck of the patient when the patient does not need to be lift (that is, the patient is in the ordinary prone position). In contrast, when conventional air cells (without structurally-weakened regions) are used to lift prone patients and turn the head/face of the patient, the air cells compress the shoulder-neck regions of the patient excessively while the patient is waiting to be lifted. Therefore, a serious health hazard especially to patients with respiratory diseases will occur. In an attempt to overcome this drawback, the conventional prone position turning mechanism requires at least two healthcare workers to manually lift the torso of the patient, so as to reduce the pressure on the patient's airways during the turning process.

Furthermore, an additional control solenoid valve or manual valve, an additional control logic, and an additional air flow channel are provided to the shoulder-neck air cell 13 which particularly needs a supporting force, leading to a great increase in technology cost and difficulty in operation by healthcare workers. Therefore, the structurally-weakened region 36 is cost-effective, minimize a risk of erroneous operation, and an effective, easy means of problem solving.

In some embodiments, the connecting segment 320, the connecting segment 340 and the connecting segment 370 are threads formed by radio frequency heating and jointing technology. In some embodiments, in addition to the shoulder-neck air cell 13, the other air cells (for example, the head air cell 11 and torso air cells 15) of the air mattress 10 are threads formed by radio frequency heating and jointing technology, so as to divide each of the shoulder-neck air cell 13 and the other air cells into at least two air chambers.

As shown in FIG. 3, in some embodiments, the connecting segment 320 of the first air chamber 32 comprises a first retracting segment 322 and two first adjoining segments 324 which flank the first retracting segment 322. The connecting segment 340 of the second air chamber 34 comprises a second retracting segment 342 and two second adjoining segments 344 which flank the second retracting segment 342. The first adjoining segments 324 connect to the second adjoining segments 344. The structurally-weakened region 36 is disposed between the first retracting segment 322 and the second retracting segment 342. In some embodiments, the two ends of the first retracting segment 322 connect to the two ends of the second retracting segment 342 to form the structurally-weakened region 36. Therefore, the structurally-weakened region 36 is formed by connecting two retracting segments. In some embodiments, as shown in FIG. 4, the two retracting segments for forming the structurally-weakened region 36 are independently disposed in the first air chamber 32 or second air chamber 34 (not shown) without being connected to the connecting segments 320, 340.

In some embodiments, as shown in FIG. 4, the first air chamber 32 or the second air chamber 34 has retracting segments which are independently disposed in the first air chamber 32 or second air chamber 34 without being connected to the connecting segments 320, 340. The retracting segments may be not for use in forming the structurally-weakened region 36. In this embodiment, the retracting segments not for use in forming the structurally-weakened region 36 and not connecting to the connecting segments are connected to the adjoining segments, and the adjoining segments, in the same air chamber, connecting to different retracting segments are not connected together. That is to say, in the same air chamber, the different retracting segments not for use in forming the structurally-weakened region 36 and not connecting to the connecting segments are not indirectly connected together through the adjoining segments. Therefore, the structural strength between the air chambers is enhanced. The risk of flipping or bending between the air chambers is decreased.

As shown in FIG. 3, in some embodiments, the first adjoining segments 324 and the second adjoining segments 344 may be a bending shape or a curved shape with an upward bulging deviation distance or a downward denting deviation distance to increase the bending resistance between the first air chamber 32 and the second air chamber 34. Therefore, the first air chamber 32 does not flip to the height of the second air chamber 34 (i.e. the vertical distance between the top of the second air chamber 34 and the bottom of the air mattress 10) due to the patient's weight while the patient is lying on the air mattress 10. In other words, with the first adjoining segments 324 and the second adjoining segments 344 being curved or arc like shape, the vertical distance between the top of the shoulder-neck air cell 13 and the bottom of the air mattress 10 will not be reduced due to the patient's weight, and the risk of a collapse of the tube (air cell) caused by bulging downward under weight or pressure or through lack of strength (air cell) is reduced at the same time, so as to ensure that the patient can comfortably lie on the air mattress 10.

Figure 5:
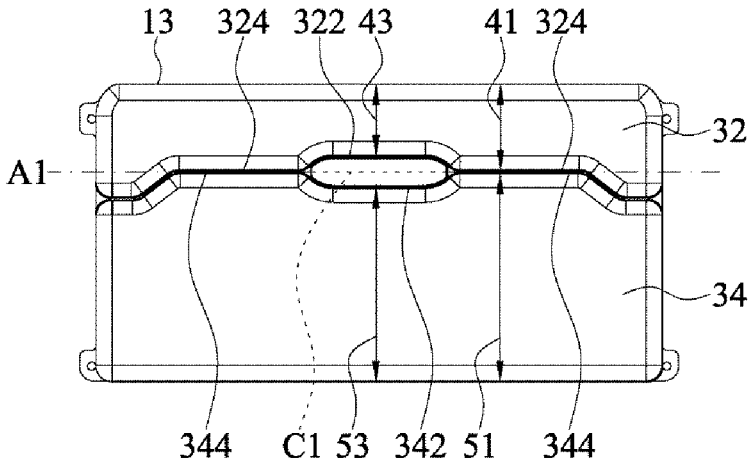

Referring to FIG. 5, FIG. 5 is a front schematic view of the shoulder-neck air cell 13 according to some embodiments of the present disclosure. In some embodiments, the first adjoining segments 324, the first retracting segment 322, the second retracting segment 342 and the second adjoining segments 344 are substantially coaxial. For instance, a central line C1 (indicated by a dashed line in FIG. 5) is between the first retracting segment 322 and the second retracting segment 342. The central line C1, the first adjoining segments 324 and the second adjoining segments 344 lie on the same axis A1 (indicated by a chain dotted line in FIG. 5). In some embodiments, as shown in FIG. 3, the axis A1 substantially lies on central line C2 of the shoulder-neck air cell 13. Therefore, the first air chamber 32 and the second air chamber 34 have the same capacity or different capacity, and the structurally-weakened region 36 is disposed between the first air chamber 32 and the second air chamber 34. Furthermore, with axis A1 lying substantially at central line C2, the discomfort of the patient for excessively sinking into shoulder-neck air cell 13 under the patient's weight while the patient is in a prone position is reduced.

Figure 6:
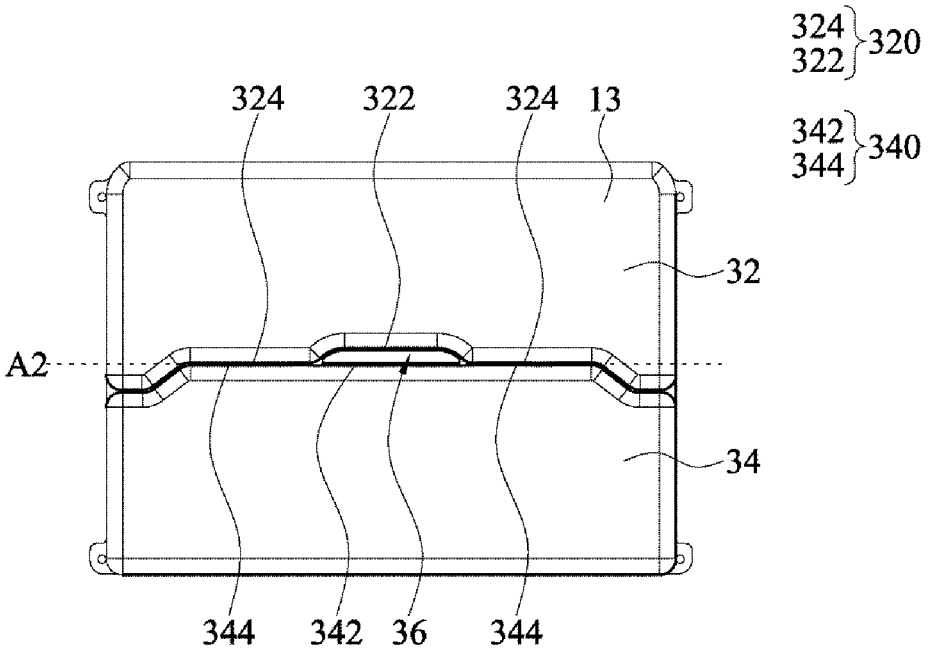

Referring to FIG. 6, FIG. 6 is a front schematic view of the shoulder-neck air cell 13 according to some embodiments of the present disclosure. In some embodiments, the retracting segment and the adjoining segments of one of two connecting segments (i.e., connecting segment 320 and connecting segment 340) are coaxial. For instance, as shown in FIG. 6, the second retracting segment 342 and the second adjoining segments 344 of the connecting segment 340 are coaxial A2. Therefore, the shape of the structurally-weakened region 36 and the related cushioning effect are altered.

Figure 7:
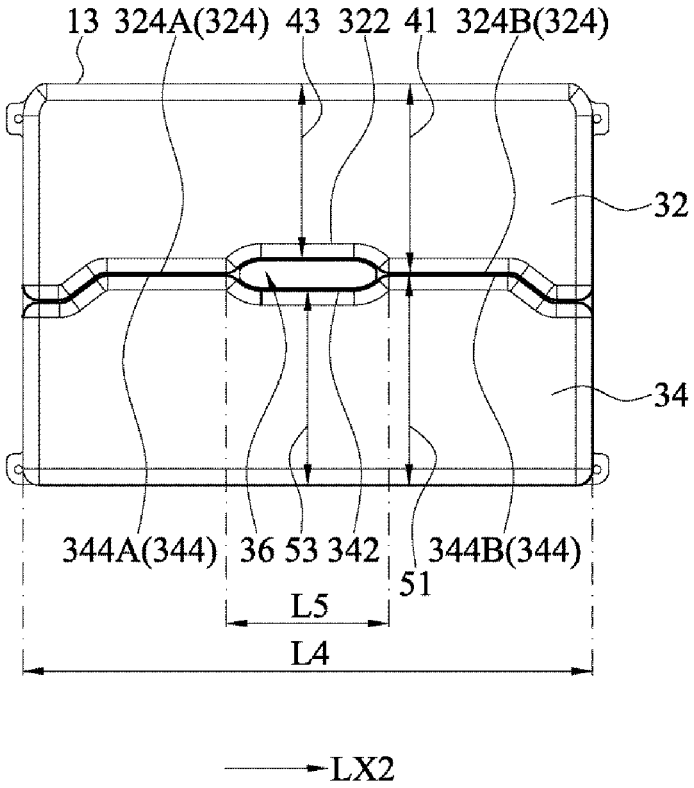
Figure 8:
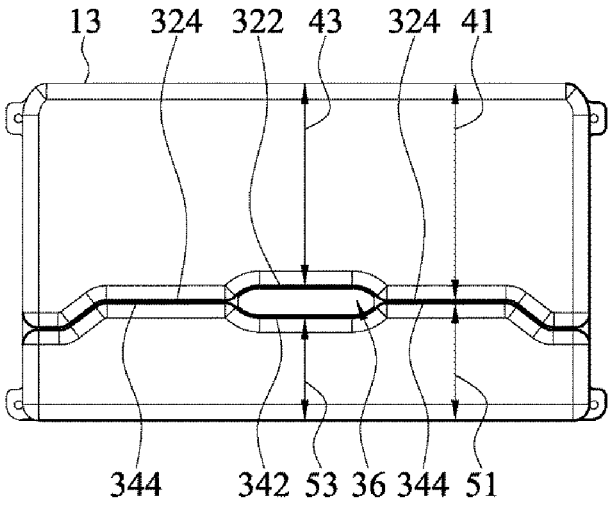

Referring to FIG. 7, FIG. 7 is a front schematic view of the shoulder-neck air cell 13 according to some embodiments of the present disclosure. Referring to FIG. 8, FIG. 8 is a front schematic view of the shoulder-neck air cell 13 according to some embodiments of the present disclosure. In some embodiments, the first air chamber 32 has a first chamber height 41, and a second air chamber 34 has a second chamber height 51. The first chamber height 41 is the distance between the top of the shoulder-neck air cell 13 and the first adjoining segments 324. The second chamber height 51 is the distance between the bottom of the shoulder-neck air cell 13 and the second adjoining segments 344. The ratio of the first chamber height 41 to the second chamber height 51 is not less than 0.3 and not greater than 3. For instance, the ratio of the first chamber height 41 to the second chamber height 51 is substantially 0.3 as shown in FIG. 5, and the ratio of the first chamber height 41 to the second chamber height 51 is substantially 3 as shown in FIG. 8. The ratio results from the division of the first chamber height 41 by the second chamber height 51. Therefore, the ratio of the first chamber height 41 to the second chamber height 51 is variable, such that the first air chamber 32 and the second air chamber 34 have the same capacity or different capacity, so as to provide optimal comfort to different patients. In some embodiments, the ratio of the first chamber height 41 to the second chamber height 51 is calculated according to the distance between the top/bottom of the shoulder-neck air cell 13 and the relative positions of the first adjoining segments 324 and the second adjoining segments 344.

As shown in FIG. 7, in some embodiments, the first air chamber 32 has a first channel height 43 corresponding in position to the first retracting segment 322, and the second air chamber 34 has a second channel height 53 corresponding in position to the second retracting segment 342. The first channel height 43 is the distance between the top of the shoulder-neck air cell 13 and the first retracting segment 322. The second channel height 53 is the distance between the bottom of the shoulder-neck air cell 13 and the second retracting segment 342. The ratio of the first channel height 43 to the second channel height 53 is not less than 0.3 and not greater than 3. For instance, the ratio of the first channel height 43 to the second channel height 53 is substantially 0.3 as shown in FIG. 5, and the ratio of the first channel height 43 to the second channel height 53 is substantially 3 as shown in FIG. 8. The ratio results from the division of the first channel height 43 by the second channel height 53. Therefore, given the variable ration of the first channel height 43 to the second channel height 53, the structurally-weakened region 36 is closer to the top side of the air mattress 10, is closer to the central line C2 (shown in FIG. 3) of the shoulder-neck air cell 13, or is closer to the bottom of the air mattress 10, so as to have a cushioning effect on different patients (for example, different body weights of the patients). Consequently, a prone patient does not excessively sink into the shoulder-neck air cell 13 (i.e., the patient's shoulder-neck region does not entirely cover by the shoulder-neck air cell 13) under his or her weight and the discomfort of the patient is reduced. In some embodiments, the ratio of the first channel height 43 to the second channel height 53 is calculated according to the distance between the top/bottom of the shoulder-neck air cell 13 and relative positions of the first retracting segment 322 and the second retracting segment 342.

As shown in FIG. 7, in some embodiments, the first channel height 43 corresponding in position to the center of the first retracting segment 322 of the first air chamber 32 is less than the first channel height 43 corresponding in position to two ends of the first retracting segment 322 of the first air chamber 32. the second channel height 53 corresponding in position to the center of the second retracting segment 342 of the second air chamber 34 is less than the second channel height 53 corresponding in position to two ends of the second retracting segment 342 of the second air chamber 34. Therefore, the first channel height 43 and the second channel height 53 increase gradually toward the two ends of the first retracting segment 322 and toward the two ends of the second retracting segment 342 (i.e., toward the two sides of the structurally-weakened region 36), respectively. Consequently, not only are a support effect and a cushion effect achieved, but the patient's body is also fixed in place and unlikely falls off the air mattress 10.

In some embodiments, a correlation is between the first chamber height 41 and the first channel height 43, and a correlation is between the second chamber height 51 and the second channel height 53. In some embodiments, a correlation is between the first chamber height 41, the first channel height 43, the second chamber height 51, and the second channel height 53. For example, when the first chamber height 41 decreases by 2 cm, the first channel height 43 also decreases by 2 cm. Similarly, when the second chamber height 51 increases by 2 cm, the second channel height 53 also increases by 2 cm.

Figure 9:
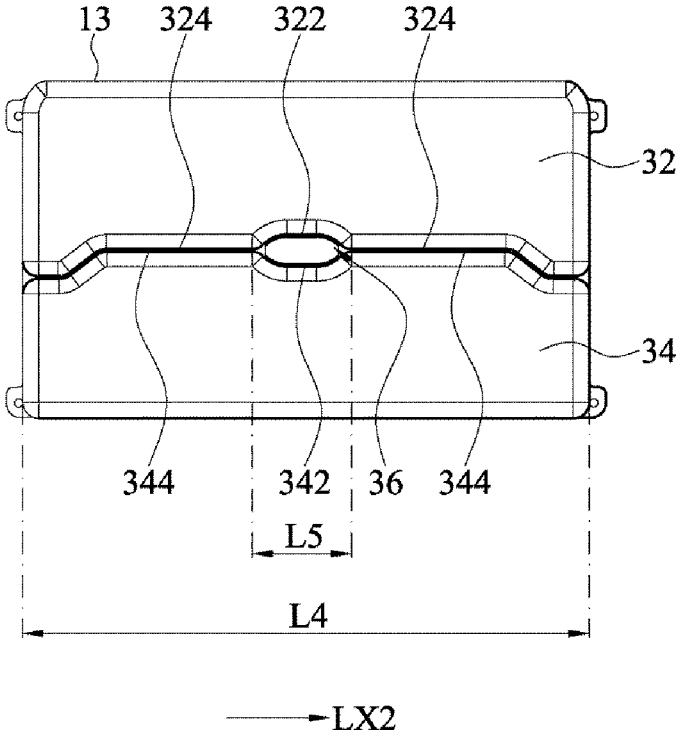
Figure 10:
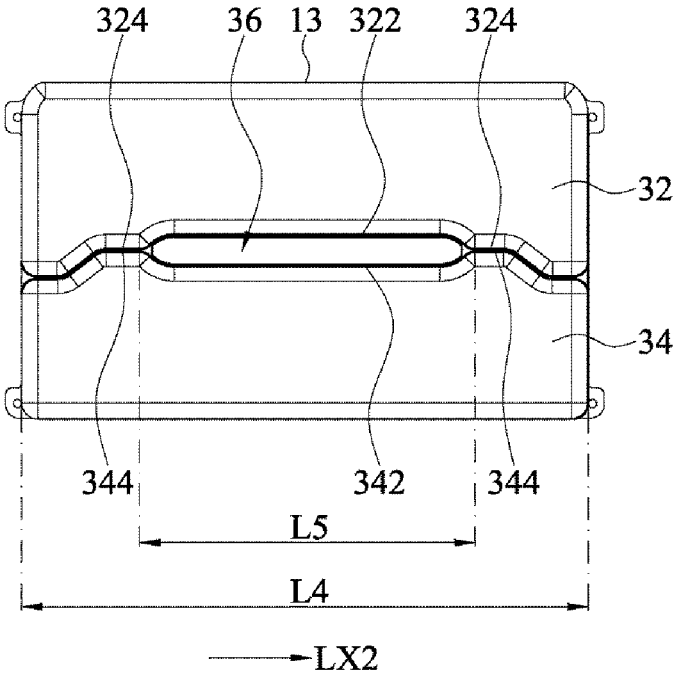

Refer to FIG. 7, FIG. 9 and FIG. 10. FIG. 9 is a front schematic view of the shoulder-neck air cell 13 according to some embodiments of the present disclosure. FIG. 10 is a front schematic view of the shoulder-neck air cell 13 according to some embodiments of the present disclosure. In some embodiments, the length of the shoulder-neck air cell 13 in a major axis direction LX2 is a first length L4. The major axis direction LX2 runs from the right side of the air mattress 10 to the left side of the air mattress 10 (or from the left side of the air mattress 10 to the right side of the air mattress 10). The length of the structurally-weakened region 36 in major axis direction LX2 is a second length L5. The ratio of the second length L5 to the first length L4 is not less than 0.2 and not greater than 0.8. For instance, the ratio of the second length L5 to first length L4 is substantially 0.2 as shown in FIG. 9, and the ratio of the second length L5 to the first length L4 is substantially 0.8 as shown in FIG. 10. The ratio results from the division of the second length L5 by the first length L4. Therefore, the structurally-weakened region 36 occupies a variable percentage of the shoulder-neck air cell 13 in order to have a cushioning effect on different patients.

In some embodiments, the first chamber height 41, the second chamber height 51, the first channel height 43, the second channel height 53, the first length L4, and the second length L5 are measured when the shoulder-neck air cell 13 is not inflated and lies flat, but the present disclosure is not limited thereto.

Figure 11:
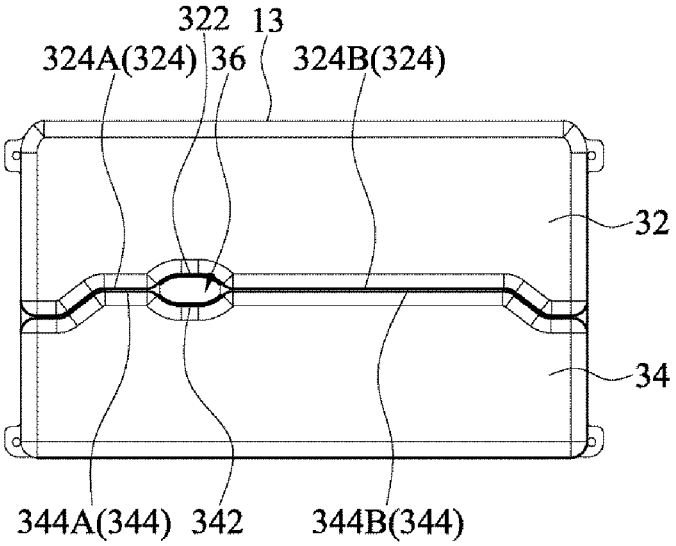
Figure 12:
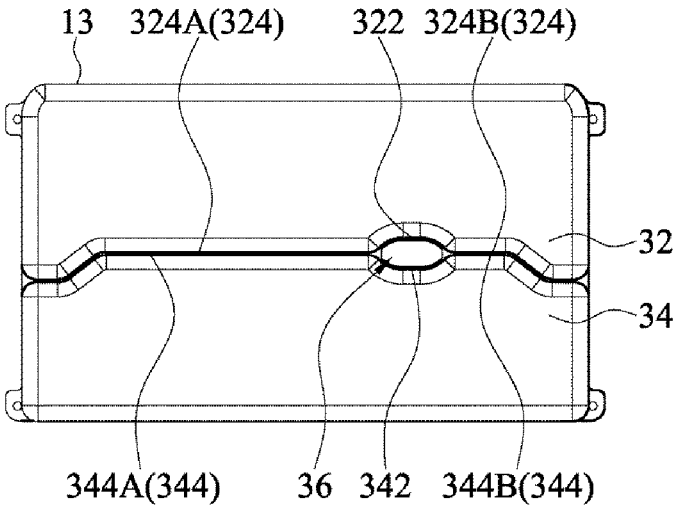

Refer to FIG. 7, FIG. 11 and FIG. 12. FIG. 11 is a front schematic view of the shoulder-neck air cell 13 according to some embodiments of the present disclosure. FIG. 12 is a front schematic view of the shoulder-neck air cell 13 according to some embodiments of the present disclosure. In some embodiments, the length ratio of the first adjoining segments and the second adjoining segments on the same one side of the first retracting segment 322 and the second retracting segment 342 (for instance, the first adjoining segments 324A and the second adjoining segments 344A on the left side of the first retracting segment 322 and the second retracting segment 342) to the first adjoining segments and the second adjoining segments on the same other side of the first retracting segment 322 and the second retracting segment 342 (for instance, the first adjoining segments 324B and the second adjoining segments 344B on the right side of the first retracting segment 322 and the second retracting segment 342) is not less than 0.2 and not greater than 5. For instance, the length ratio of the first adjoining segments 324A and the second adjoining segments 344A to the first adjoining segments 324B and the second adjoining segments 344B is substantially 0.2 as shown in FIG. 11, and the length ratio of the first adjoining segments 324A and the second adjoining segments 344A to the first adjoining segments 324B and the second adjoining segments 344B is substantially 5 as shown in FIG. 12. The ratio results from the division of the length of the first adjoining segments 324A by the length of the first adjoining segments 324B, and/or the ratio results from the division of the length of the second adjoining segments 344A by the length of the second adjoining segments 344B. Therefore, the structurally-weakened region 36 is closer to the left side of the air mattress 10, the right side of the air mattress 10, or the central line of the air mattress 10 in order to have a cushioning effect on different patients.

Figure 13:
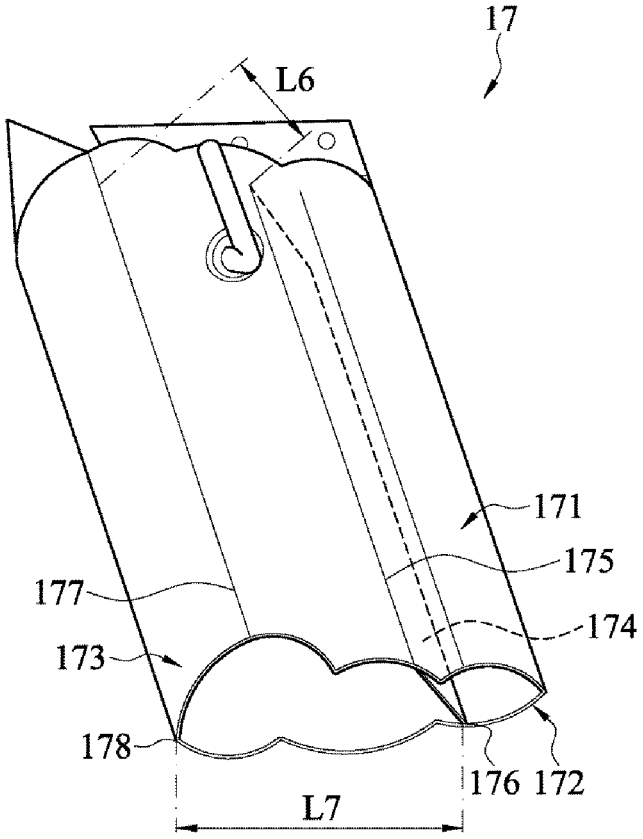
FIG. 13 is a cutaway view of the body-lifting air cell according to some embodiments of the present disclosure.

Refer to FIG. 2 and FIG. 13. FIG. 13 is a cutaway view of the body-lifting air cell 17 according to some embodiments of the present disclosure. In some embodiments, the body-lifting air cell 17 comprises a mattress attaching side 171, a bottom side 172, a fall side 173 and a leash or stripe 174. A triangular prism like shape is substantially formed in an inflated state by connecting one end of the mattress attaching side 171 to one end of the bottom side 172, followed by connecting the other end of the bottom side 172 to one end of the fall side 173, and then followed by connecting the other end of the fall side 173 to the other end of the mattress attaching side 171. Referring to FIG. 13, the triangular prism like shape is based on the angle of view of the cross section of the air mattress 10. When the air mattress 10 is in use, the mattress attaching side 171 faces the shoulder-neck air cell 13 and the at least one of the torso air cells 15 (i.e., thorax air cells 150). The stripe 174 (or the leash) is disposed in the body-lifting air cell 17 and connected to the mattress attaching side 171 and bottom side 172. When the body-lifting air cell 17 is inflated, the mattress attaching side 171 attaches against the shoulder-neck air cell 13 and the thorax air cells 150. The fall side 173 raises the shoulder-neck air cell 13 and the thorax air cells 150 by first distance L1 and the third distance L3, respectively. Furthermore, the length of the fall side 173 is maintained with the leash 174, thereby preventing a deformation from the body-lifting air cell 17.

As shown in FIG. 13, in some embodiments, the junction of the leash 174 and the mattress attaching side 171 is a first connection end 175, and the junction of the leash 174 and the bottom side 172 is a second connection end 176. The distance between the first connection end 175 and a junction 177 of the mattress attaching side 171 and the fall side 173 is a third length L6. The distance between the second connection end 176 and a junction 178 of the bottom side 172 and the fall side 173 is a fourth length L7. The fourth length L7 is not less than the third length L6. With the fourth length L7 being not less than the third length L6, the length of the fall side 173 can be maintained to thereby preventing a deformation from the body-lifting air cell 17. As shown in FIG. 2, in some embodiments, the junction 177 of the mattress attaching side 171 and the fall side 173 is at the shoulder-neck air cell 13. Therefore, with the junction 177 attaching against the shoulder-neck air cell 13, the shoulder-neck air cell 13 can be lifted. In some embodiments, the junction of the mattress attaching side 171 and the bottom side 172 comes with a shaping element, for example, a spherical air cell (not shown), to ensure that the body-lifting air cell 17 is a triangular prism like shape and thus are not deformable. Therefore, with the body-lifting air cell 17 being inflated and the acute angle being adjustable according to the scope of a use scenario, the stripe 174 (or the leash) ensures that the triangular prism like shape of the body-lifting air cell 17 can be maintained. Consequently, the consistency and the coherence between the height which the patient's shoulder-neck region and thorax are lifted to reach are ensured, and the consistency and the coherence of the lift-related gradient are ensured.

Figure 14:
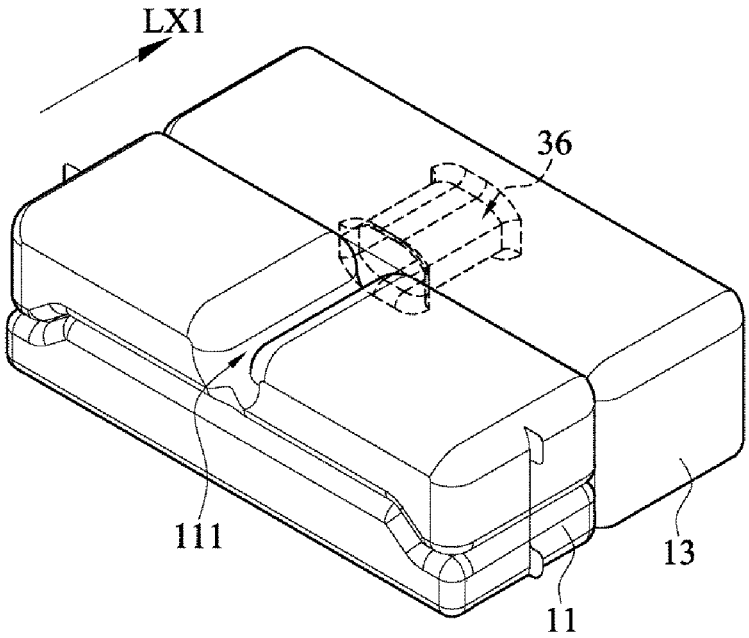
FIG. 14 is a schematic perspective view of a head air cell and the shoulder-neck air cell according to some embodiments of the present disclosure.

Referring to FIG. 14, FIG. 14 is shown a schematic perspective view of a head air cell 11 and a shoulder-neck air cell 13 according to some embodiments of the present disclosure. In some embodiments, the top side of each head air cell 11 has a groove 111. The groove 111 and the structurally-weakened region 36 extend in the same direction. For instance, the groove 111 and the structurally-weakened region 36 extend in major axis direction LX1 of the air mattress 10. The groove 111 is to reduce the pressure exerted on the head air cell 11 by an ear of the patient in a prone position. In some embodiments, two top ends of the openings of the groove 111 each have a lead angle for assisting with the insertion of the ear into the groove 111. In some embodiments, the depth and the openings of the groove 111 are designed according to the size of different patients' ears.

Figure 15:
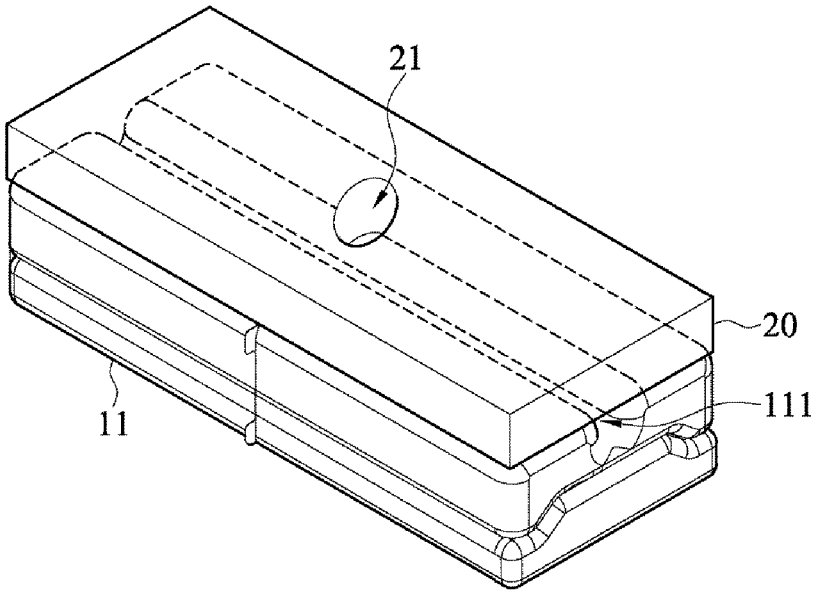
FIG. 15 is a schematic perspective view of a buffer layer and the head air cell according to some embodiments of the present disclosure.
Figure 16:
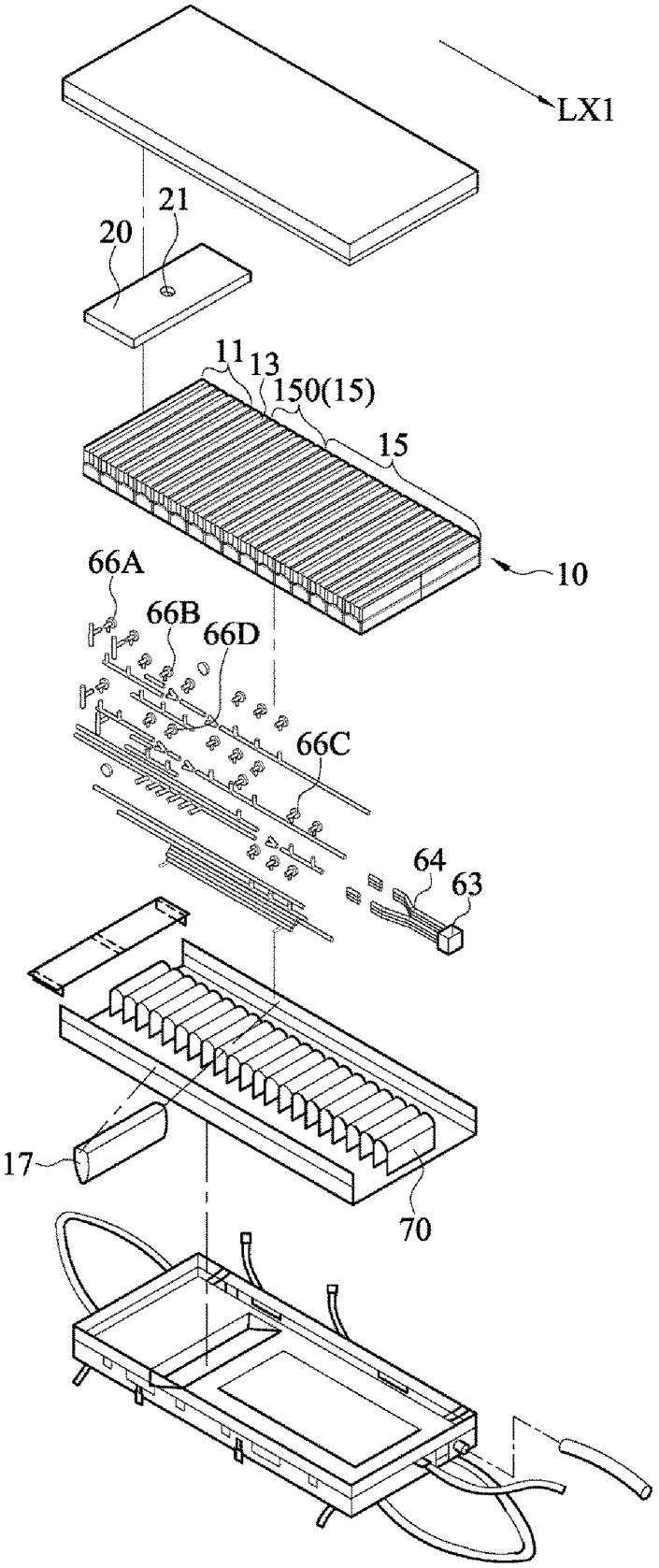
FIG. 16 is an exploded view of the air mattress of the present disclosure.

Referring to FIG. 15, FIG. 15 is shown a schematic perspective view of a buffer layer 20 and the head air cell 11 according to some embodiments of the present disclosure. In some embodiments, the air mattress 10 further comprises the buffer layer 20. The buffer layer 20 is adjacent to the head air cell 11. For instance, the buffer layer 20 is disposed on the head air cell 11, and thus the buffer layer 20 is closer to the air mattress 10 than the head air cell 11. For the sake of illustration, FIG. 16 shows one head air cell 11 disposed below the buffer layer 20, but the present disclosure is not limited thereto. The buffer layer 20 has an orifice 21 corresponding in position to the groove 111 of the head air cell 11. The orifice 21 is disposed on the top side of the buffer layer 20. Therefore, the orifice is disposed on the top side of the air mattress 10. In some embodiments, the orifice 21 corresponds in position to the openings of the groove 111. The orifice 21 and the groove 111 together reduce the pressure exerted by the ear on the head air cell 11. In some embodiments, the size of the orifice 21 is designed according to the size of different patients' ears. In some embodiments, the orifice 21 has an elliptical cross section, wherein the ratio of the elliptical cross section of a major axis to the elliptical cross section of a major axis of a minor axis ranges from 1 to 3.

Figure 17:
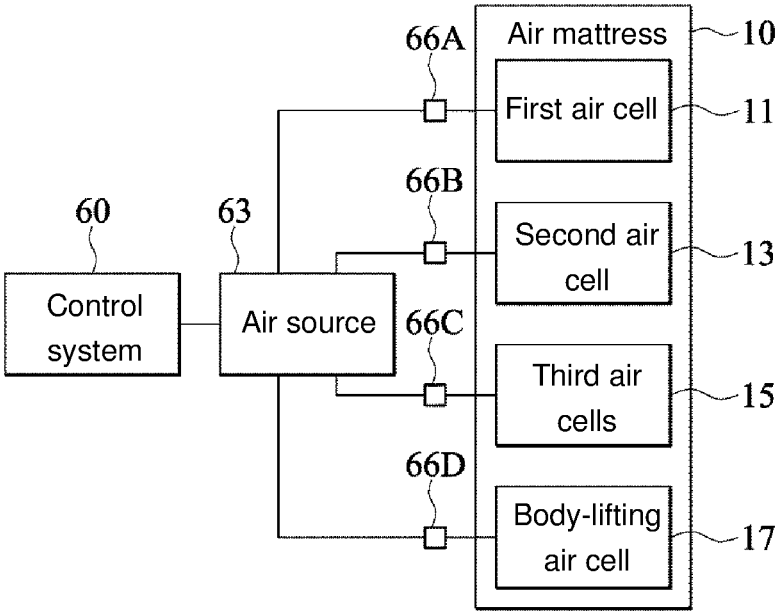
FIG. 17 is a block diagram of a control system and a gas loop according to some embodiments of the present disclosure.

Refer to FIG. 16 and FIG. 17. FIG. 16 is an exploded view of the air mattress 10 of the present disclosure. FIG. 17 is a block diagram of a control system 60 and a gas loop according to some embodiments of the present disclosure. In some embodiments, the air mattress 10 is connected to an air source 63. For instance, the head air cells 11, the shoulder-neck air cell 13, the torso air cells 15 and the body-lifting air cell 17 of the air mattress 10 are connected to the air source 63 by pipelines. For the sake of illustration, FIG. 17 shows just one head air cell 11 and one torso air cell 15, but the present disclosure is not limited thereto. The air source 63 is controlled by the control system 60 to inflate and deflate the head air cell 11, the shoulder-neck air cell 13, the torso air cell 15 and the body-lifting air cell 17 of the air mattress 10. The control system 60 comprises a processor and memory. The processor is a computation circuit, such as a microprocessor or a system chip. The memory is volatile or nonvolatile memory. The memory stores programs readable by the processor to execute control over the air source 63. The air source 63 comprises an inflation unit and a deflation unit. The inflation unit inflates the head air cells 11, the shoulder-neck air cell 13, the torso air cells 15 and the body-lifting air cell 17. The deflation unit deflates the head air cells 11, the shoulder-neck air cell 13, the torso air cells 15 and the body-lifting air cell 17. The inflation unit is a blower, a compressor or any other air current generating device. The deflation unit is a reverse valve, a solenoid valve or any other valve for controlling a fluid. In some embodiments, deflation valves 66A-66D are disposed between a gas pipeline 64 and the air source 63. Gas is transmitted from the air source 63 to the head air cells 11, the shoulder-neck air cell 13, the torso air cells 15 and the body-lifting air cell 17 and from the head air cells 11, the shoulder-neck air cell 13, the torso air cells 15 and the body-lifting air cell 17 to the air source 63, through the gas pipeline 64. The deflation valves 66A-66D are three-way reverse valves. The deflation valves 66A-66D control the circulation of gas between the inflation source 63 and respective air cells (with the deflation valve 66A corresponding in position to the head air cell 11, the deflation valve 66B corresponding in position to the shoulder-neck air cell 13, the deflation valve 66C corresponding in position to the torso air cells 15, and the deflation valve 66D corresponding in position to the body-lifting air cell 17, for example) to deflate the respective air cells or stop deflation. A person (for example, a healthcare worker) may start and shut down the deflation valves 66A-66D. In some embodiments, the control system 60, the air source 63 and the air mattress 10 are integrated into one single air mattress.

Figure 18:
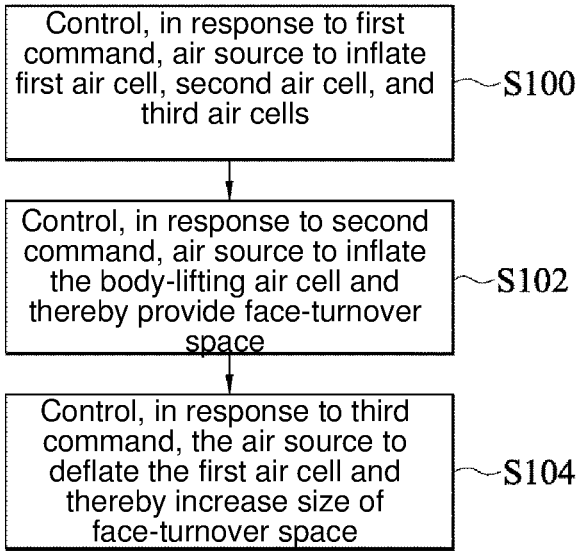
FIG. 18 is a schematic view of a process flow of a method of controlling an air mattress according to some embodiments of the present disclosure.

Referring to FIG. 18, FIG. 18 is a schematic view of a process flow of a method of controlling the air mattress 10 according to some embodiments of the present disclosure. First, in response to a first command, the control system 60 controls the air source 63 to inflate the head air cell 11, the shoulder-neck air cell 13 and the torso air cells 15 (step S100). In some embodiments, the control system 60 inflates the head air cell 11, the shoulder-neck air cell 13 and the torso air cells 15 collectively or separately. Therefore, the head air cell 11, the shoulder-neck air cell 13 and the torso air cells 15 are inflated simultaneously or not simultaneously.

Then, in response to a second command, the control system 60 controls the air source 63 to inflate the body-lifting air cell 17 to provide face-turnover space (step S102). For instance, when the patient is lying in a prone position and needs to have his or her head/face turned, the control system 60 receives and responds to the second command to thereby control the air source 63 to inflate the body-lifting air cell 17 in order to lift the shoulder-neck air cell 13 and thethorax air cells 150. Then, the patient's shoulder-thorax region is lifted by the shoulder-neck air cell 13 and the thorax air cells 150, and the face-turnover space is provided so that healthcare workers may easily turn the patient's head. Lifting the shoulder-thorax region of a patient with a special body shape is likely to cause compression to the patient's neck or cause hyperextension by extending the patient's vertebral column, especially cervical spine, excessively. Therefore, the structurally-weakened region 36 in the shoulder-neck air cell 13 cushions external forces and thereby achieves depressurization of the patient's neck. In some embodiments, the air source 63 inflates the body-lifting air cell 17 to different levels, as indicated by the difference of the values of pressure inside the inflated air cells. An angle formed by the body-lifting air cell 17 and the bottom of the air mattress 10 may have a value difference according to the difference of the values of pressure inside the inflated air cells when the shoulder-neck air cell 13 and the thorax air cells 150 are lifted by the body-lifting air cell 17.

Figure 19:
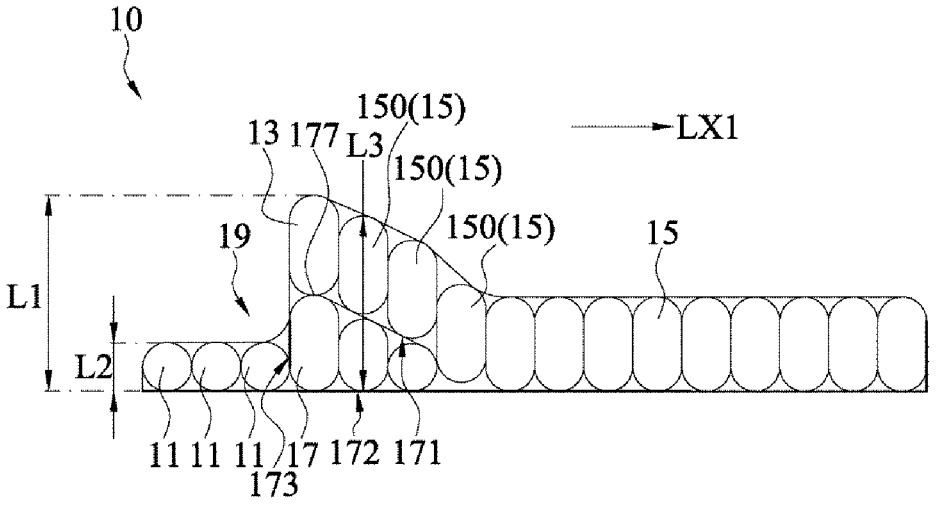
FIG. 19 is a left schematic view of the air mattress when the body-lifting air cell is inflated and the head air cell is deflated according to some embodiments of the present disclosure.

Referring to FIG. 19, FIG. 19 is a left schematic view of the air mattress 10 upon inflation of the body-lifting air cell 17 and deflation of the head air cell 11 according to some embodiments of the present disclosure. In some embodiments, after inflating the body-lifting air cell 17, the control system 60 controls, in response to a third command, the air source 63 to deflate the head air cell 11 and thereby increase the size of the face-turnover space 19 (step S104). The size of the face-turnover space 19 depends on the vertical distance between the top of the head air cell 11 and the bottom of the air mattress 10. The size of the face-turnover space 19 is defined by the difference obtained by subtracting second distance L2 from first distance L1. In some embodiments of step S104, the head air cells 11 are deflated in whole or in part. The deflation of the head air cells 11 results in the larger face-turnover space 19 to thereby allow healthcare workers to turn the patient's head quickly. In some embodiments, after the healthcare workers have turned the patient's head/face (for example, at the end of a predetermined face-turnover time period), the control system 60 controls the inflation source 63 to inflate the head air cells 11 and to support the patient's head region again, and the control system 60 controls the air source 63 to deflate the body-lifting air cell 17 and thereby enable the patient to resume a prone position.

In some embodiments, the deflation of air cells is achieved by a user's turning on the deflation valves 66A-66D, and the renewed inflation of air cells is achieved by the user's turning off the deflation valves 66A-66D. In some embodiments, the commands which the control system 60 responds to are inputted by the user or generated by the control system 60 being operated by the user. In some embodiments, as shown in FIG. 16, each air cell is enclosed by a shaping cord 70 for supporting the air cell.

In conclusion, according to some embodiments, the present disclosure is effective in inflating the body-lifting air cell to lift the patient's shoulder-thorax region automatically and to provide a face-turnover space to turn the patient's head/face with fewer healthcare workers. In some embodiments, with the patient's shoulder-thorax region being lifted, the structurally-weakened region in the shoulder-neck air cell enables the shoulder-neck air cell to have a cushioning effect against external forces (for example, the pressure exerted by the patient's shoulder-neck region on the shoulder-neck air cell). In some embodiments, the pressure exerted by the patient's shoulder-neck region on the shoulder-neck air cell is reduced through the structurally-weakened region while supporting the patient's shoulder-neck region by the shoulder-neck air cell. In addition, the chance of hyperextension which is caused by extending the prone patient's vertebral column, especially cervical spine, excessively is reduced. In some embodiments, the pressure exerted on the lateral face (especially the ear) of the prone patient is reduced through an orifice of a buffer layer, and thus the chance of developing bedsores on the prone patient's face is also reduced.

What is claimed is:

1. An air mattress, adapted to be selectively inflated or deflated by an air source controlled by a control system, the air mattress comprising: at least one first air cell at a head end of the air mattress; a second air cell disposed adjacent to the at least one first air cell and comprising a first air chamber, a second air chamber, and a structurally-weakened region, wherein the structurally-weakened region is a hollowed-out region, wherein the first air chamber is adjacent to the second air chamber, and the structurally-weakened region is enclosed in the second air cell; a plurality of third air cells adjacent to the second air cell without directly contacting the at least one first air cell; and a body-lifting air cell substantially at a lower position of the second air cell and at least one of the third air cells, wherein when the air mattress is in use, the air source inflates the body-lifting air cell to lift the second air cell and the at least one of the third air cells, and a vertical distance between a top of the second air cell and a bottom of the air mattress is a first distance, and a vertical distance between a top of the at least one first air cell and the bottom of the air mattress is a second distance, and the first distance is greater than the second distance, wherein the structurally-weakened region enclosed in the second air cell has a lower structural strength than that of any of the other air cells forming the air mattress when the air mattress is in use achieving a cushioning effect of the second air cell against external forces applied to an upper supporting surface of the air mattress, and wherein the structurally-weakened region has an opening that does not face the direction of the external forces, so as to achieve the cushioning effect of the second air cell against the external forces.

2. The air mattress of claim 1, wherein the second air cell supports a shoulder-neck region of a patient lying on the air mattress, and pressure applied to the shoulder-neck region of the patient from the second air cell is decreased by the cushioning effect of the second air cell.

3. The air mattress of claim 1, wherein at least one of the third air cells above the body-lifting air cell are lifted by the body-lifting air cell to form an acute angle with the bottom of the air mattress.

4. The air mattress of claim 1, wherein the first air chamber and the second air chamber each comprise a connecting segment, wherein the connecting segment of the first air chamber further comprises a first retracting segment and two first adjoining segments which flank the first retracting segment, wherein the connecting segment of the second air chamber comprises a second retracting segment and two second adjoining segments which flank the second retracting segment, wherein the two first adjoining segments connect to the two second adjoining segments, and the structurally-weakened region is disposed between the first retracting segment and the second retracting segment.

5. The air mattress of claim 1, wherein a connecting segment is disposed between the first air chamber and the second air chamber and comprises a third retracting segment, a fourth retracting segment, and at least one adjoining segment connected to the third retracting segment or the fourth retracting segment, wherein the structurally-weakened region is enclosed in the first air chamber or the second air chamber and is substantially not connected to the connecting segment.

6. The air mattress of claim 1, wherein the first air chamber has a first chamber height, and the second air chamber has a second chamber height, wherein the ratio of the first chamber height to the second chamber height is not less than 0.3 and not greater than 3.

7. The air mattress of claim 4, wherein the first air chamber has a first channel height corresponding in position to the first retracting segment, and the second air chamber has a second channel height corresponding in position to the second retracting segment, wherein the ratio of the first channel height to the second channel height is not less than 0.3 and not greater than 3.

8. The air mattress of claim 1, wherein the body-lifting air cell comprises a mattress attaching side, a bottom side, a fall side and a stripe inside the body-lifting air cell, wherein the mattress attaching side, the bottom side, and the fall side are connected in sequence and substantially form a triangular prism shape when the body-lifting air cell is inflated, wherein the mattress attaching side faces the second air cell and the at least one of the third air cells, wherein the stripe is disposed in the body-lifting air cell and connected to the mattress attaching side and the bottom side.

9. The air mattress of claim 8, wherein a junction of the stripe and the mattress attaching side is a first connection end, and a junction of the stripe and the bottom side is a second connection end, wherein the distance between the first connection end and a junction of the mattress attaching side and the fall side is a third length, and the distance between the second connection end and a junction of the bottom side and the fall side is a fourth length, wherein the fourth length is not less than the third length.

10. The air mattress of claim 1, wherein the air mattress further comprises a buffer layer adjacent to the at least one first air cell, and the buffer layer has an orifice.

11. A method of controlling an air mattress, the air mattress comprising at least one first air cell at a head end of the air mattress, a second air cell, a plurality of third air cells, and a body-lifting air cell, wherein when the air mattress is in use, the air mattress is controlled by a control system; the method comprises:

controlling, in response to a first command, an air source to inflate the at least one first air cell, the second air cell, and the third air cells, wherein the second air cell at least comprises a first air chamber, a second air chamber adjacent to the first air chamber, and a structurally-weakened region enclosed in the second air cell, wherein the structurally-weakened region is a hollowed-out region and has a lower structural strength than that of any of the other air cells forming the air mattress, wherein the second air cell is adjacent to the at least one first air cell, the third air cells are adjacent to the second air cell without directly contacting the at least one first air cell, and wherein the body-lifting air cell is substantially at a lower position of the second air cell and at least one of the third air cells; and controlling, in response to a second command, the air source to inflate the body-lifting air cell and thereby provide a face-turnover space, wherein the second air cell supports the shoulder-neck region of a patient lying on the air mattress, wherein the structurally-weakened region enclosed in the second air cell enables the second air cell to have a cushioning effect against external forces applied to an upper supporting surface of the air mattress, wherein the structurally-weakened region has an opening that does not face the direction of the external forces, so as to achieve the cushioning effect of the second air cell against the external forces.

12. The method of claim 11, further comprising controlling, in response to a third command, the control system to deflate the at least one first air cell and thereby increase the volume of the face-turnover space, wherein the volume of the face-turnover space depends on a vertical distance between the top of the at least one first air cell and the bottom of the air mattress.

* * * * *